US011319607B2

(12) United States Patent
Wang et al.

(10) Patent No.: US 11,319,607 B2
(45) Date of Patent: May 3, 2022

(54) HIGH-STRENGTH HIGH-TENACITY STEEL PLATE WITH TENSILE STRENGTH OF 800 MPA AND PRODUCTION METHOD THEREFOR

(71) Applicant: BAOSHAN IRON & STEEL CO., LTD., Shanghai (CN)

(72) Inventors: Huanrong Wang, Shanghai (CN); Ana Yang, Shanghai (CN); Wei Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 753 days.

(21) Appl. No.: 15/536,743

(22) PCT Filed: Nov. 24, 2015

(86) PCT No.: PCT/CN2015/095363
§ 371 (c)(1),
(2) Date: Jun. 16, 2017

(87) PCT Pub. No.: WO2016/095665
PCT Pub. Date: Jun. 23, 2016

(65) Prior Publication Data

US 2017/0349960 A1 Dec. 7, 2017

(30) Foreign Application Priority Data

Dec. 19, 2014 (CN) ..... 201410810259.2

(51) Int. Cl.
*C21D 8/02* (2006.01)
*C21D 1/20* (2006.01)
(Continued)

(52) U.S. Cl.
CPC ..... *C21D 8/0263* (2013.01); *C21D 1/20* (2013.01); *C21D 8/02* (2013.01); *C21D 9/46* (2013.01);
(Continued)

(58) Field of Classification Search
CPC ..... C21D 8/0263; C21D 9/46; C21D 8/02; C21D 1/20; C21D 2211/001;
(Continued)

(56) References Cited

U.S. PATENT DOCUMENTS 8,025,982 B2 * 9/2011 Futamura ..... C21D 9/46 428/659
8,597,439 B2 * 12/2013 Ikeda ..... C22C 38/04 148/320
(Continued)

FOREIGN PATENT DOCUMENTS

CN 101297051 A 10/2009
CN 102925809 A 2/2013
(Continued)

OTHER PUBLICATIONS

PCT/CN2015/095363 International Search Report and Written Opinion, dated Mar. 2, 2016.
(Continued)

*Primary Examiner* — John A Hevey
(74) *Attorney, Agent, or Firm* — Lei Fang; Smith Tempel Blaha LLC

(57) ABSTRACT

Disclosed are a high-strength and high-toughness steel plate with an 800 MPa grade tensile strength and a method for manufacturing the same, the chemical composition of the steel plate in weight percentage being: C: 0.15-0.25%, Si: 1.0-2.0%, Mn: 1.2-2.0%, P≤0.015%, S≤0.005%, Al: 0.5-1.0%, N: ≤0.006%, Nb: 0.02-0.06%, O≤0.003%, and the balance being Fe and other inevitable impurities, and
(Continued)

1.5%≤Si+Al≤2.5%. By adopting an isothermal heat treatment a high-strength and high-toughness steel plate with an 800 MPa grade tensile strength, which has a microstructure mainly including bainite ferrite and residual austenite, is obtained impact energy.

7 Claims, 1 Drawing Sheet

(51) Int. Cl.

| | |
|---|---|
| ***C22C 38/12*** | (2006.01) |
| ***C22C 38/00*** | (2006.01) |
| ***C22C 38/38*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/38* (2013.01); *C21D 2211/001* (2013.01); *C21D 2211/002* (2013.01); *C21D 2211/005* (2013.01)

(58) Field of Classification Search
CPC ..... C21D 2211/005; C21D 2211/002; C22C 38/38; C22C 38/002; C22C 38/06; C22C 38/04; C22C 38/02; C22C 38/001; C22C 38/12
See application file for complete search history.

(56) References Cited

U.S. PATENT DOCUMENTS

| | | | | |
|---|---|---|---|---|
| 9,631,266 | B2 * | 4/2017 | Futamura | C21D 9/46 |
| 2010/0172786 | A1 | 7/2010 | Nakaya et al. | |
| 2014/0170440 | A1 * | 6/2014 | Kawata | C22C 38/34 428/659 |
| 2016/0222483 | A1 * | 8/2016 | Murakami | C21D 1/20 |

FOREIGN PATENT DOCUMENTS

| | | | |
|---|---|---|---|
| CN | 103014527 | A | 4/2013 |
| CN | 103154279 | | 6/2013 |
| CN | 103154297 | | 6/2013 |
| CN | 103215516 | | 7/2013 |
| CN | 103732778 | | 4/2014 |
| CN | 104513927 | A | 4/2015 |
| EP | 1365037 | A1 | 11/2003 |
| JP | 2007162078 | | 6/2007 |
| JP | 2010156031 | | 7/2010 |

OTHER PUBLICATIONS

Peng, Huimin; "High Strength and High Toughness Steel Materials for Automobiles." Beijing Automotive Engineering, No. 1 (1996). pp. 28-34.

Examination Report dated May 4, 2016 for Application No. CN201410810259.2.

* cited by examiner

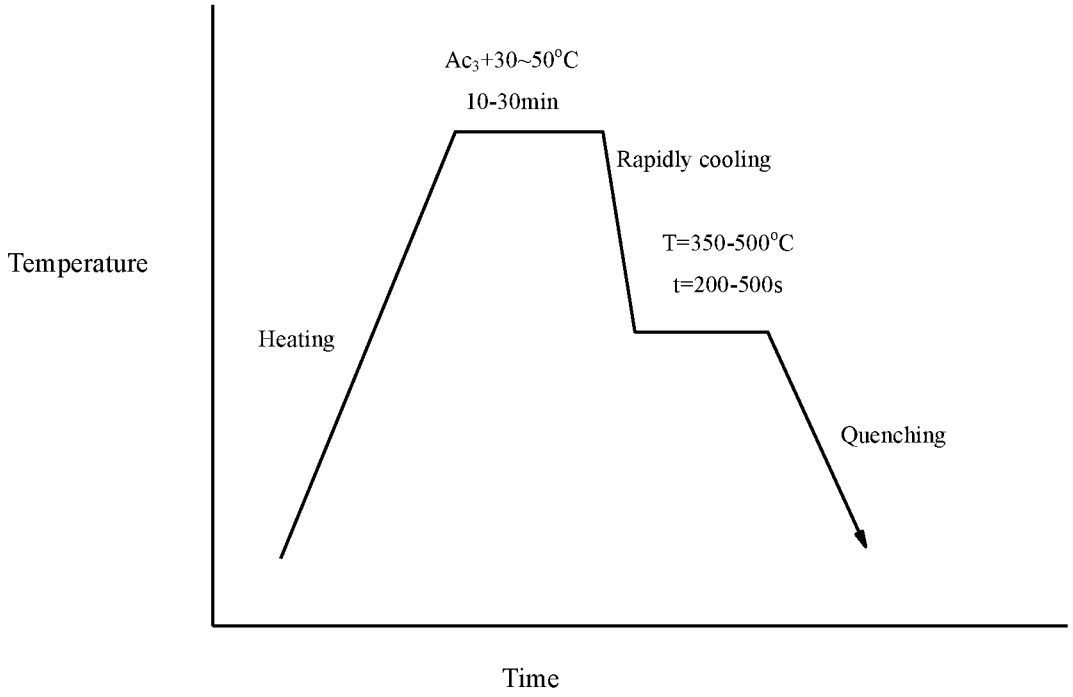
Ac3+30~50°C
10-30min
Rapidly cooling
T=350-500°C
t=200-500s
Temperature
Heating
Quenching
Time

HIGH-STRENGTH HIGH-TENACITY STEEL PLATE WITH TENSILE STRENGTH OF 800 MPA AND PRODUCTION METHOD THEREFOR

CROSS-REFERENCE TO RELATED APPLICATIONS

This application is a 371 U.S. National Phase of PCT International Application No. PCT/CN2015/095363, filed on Nov. 24, 2015, which claims benefit and priority to Chinese patent application No. 201410810259.2, filed on Dec. 19, 2014. Both of the above-referenced applications are incorporated by reference herein in their entirety.

TECHNICAL FIELD

The present invention falls within the field of structural steels, and relates to a high-strength and high-toughness steel plate with an 800 MPa grade tensile strength and a method for manufacturing the same, the obtained steel plate having a microstructure mainly including bainite ferrite and residual austenite, a yield strength of ≥390 MPa, a tensile strength of ≥800 MPa, an elongation of >20%, and an excellent low-temperature impact property with the impact energy at −20° C. being >100 J.

BACKGROUND ART

As the emission reduction standards of automobiles and particularly passenger vehicles become increasingly stringent in China, advanced high-strength steels are increasingly used in all various automobile companies to reduce the vehicle body weight so as to reduce the carbon emission and save the energy source. The development of steels for automobiles has experienced three generations so far. The first generation steels for automobiles mainly include high-strength low-alloy steels (HSLA steel), IF steels, DP steels, etc., and have found very extensive use; the second generation steels for automobiles mainly include high-strength plastic product steels represented by high manganese steels, but get little progress in the aspect of popularization and use, due to a high alloy content, a big smelting difficulty, and high costs; and in the recent decades, the third generation advanced high-strength steels represented by quenching-partitioning steels (Q&P), medium manganese steel, etc., get increasing attentions of the educational and engineering circles with respect low cost and excellent properties, and some advanced high-strength steels have been used in the field of automobiles.

With regard to automobiles, besides being environmentally friendly and energy-saving, the crash safety is a very important index. Therefore, with regard to the development of advanced high-strength steels, in addition to the emphasis on the high strength and high plasticity, requirements of impact toughness must be particularly taken into account as well. Although the third generation advanced high-strength steels, such as Q&P, have a high strength and a high plasticity, the low-temperature impact toughness is relatively poorer, due to a structure of a martensite and a residual austenite.

If steel plates with the three excellent performance indexes of strength, plasticity and toughness can be developed, they will have a very great application potential in the field of steels for automobile structures. In addition, since such high-strength steels are produced using an on-line rolling process, the property uniformity is poorer, when compared to high-strength steel by a heat treatment, with regard to the structure uniformity. As compared to high-strength steels with a structure type of a martensite and a residual austenite, the impact toughnesses of high-strength steels with a structure type of a bainite ferrite and a residual austenite are obviously improved; moreover, by the heat treatment method and isothermal transformation process, steel plates which are more excellent in uniformity of structure and mechanical properties may be obtained, and the present invention is proposed just under this background.

Patents regarding high-strength steels mainly including a bainite ferrite and a residual austenite obtained using the heat treatment process are less involved, wherein they are mainly cold-rolled high-strength steels; and patents regarding hot-rolled high-strength steels are much less. Patent CN 101155939 A introduces a cold-rolled high-strength steel, the composition design is relatively complex, wherein in addition to basic elements C, Si and Mn, more alloy elements such as Cu, Ni, Nb etc. are further added, and the cost is higher. The structure type is mainly a bainite ferrite, a polygonal ferrite and a small amount of a residual austenite and the process route is cold-rolling and continuous annealing. In addition, an isothermal heat treatment process is used in patent JP 2012126974 A to obtain a 600 MPa grade high-strength steel, and in the composition design, more Cr and Mo are added; in addition, the carbon equivalent thereof is in a higher level of 0.65-0.75, and the weldability of the steel plate is poorer.

SUMMARY OF THE INVENTION

An object of the present invention lies in providing a high-strength and high-toughness steel plate with an 800 MPa grade tensile strength and a method for manufacturing the same, the obtained steel plate having an excellent match of high strength, high plasticity and high toughness, a microstructure mainly including a bainite ferrite and a residual austenite, a yield strength of ≥390 MPa, a tensile strength of ≥800 MPa, an elongation of >20%, and an excellent low-temperature impact property with the impact energy at −20° C. being >100 J.

To achieve the above-mentioned object, the technical solution of the present invention is:

a high-strength and high-toughness steel plate with an 800 MPa grade tensile strength, the chemical composition of the steel plate in weight percentage being: C: 0.15-0.25%, Si: 1.0-2.0%, Mn: 1.2-2.0%, P: ≤0.015%, S: ≤0.005%, Al: 0.5-1.0%, N: ≤0.006%, Nb: 0.02-0.06%, O: ≤0.003%, and the balance being Fe and other inevitable impurities, with 1.5%≤Si+Al≤2.5% being satisfied.

Preferably, in the chemical composition of said high-strength and high-toughness steel plate with an 800 MPa grade tensile strength, the content of Si is in a range of 1.3-1.7%; the content of Mn is in a range of 1.4-1.8%; the content of N is ≤0.004%; and the content of Nb is in a range of 0.03-0.05%, in weight percentage.

In the composition design of the steel plate of the present invention:

on the basis of the composition of a C—Mn steel, by increasing the content of Si, the precipitation of a cementite in the process of isothermal transformation is inhibited; increasing the content of Al accelerates the diffusion of carbon atoms into the residual austenite from the bainite ferrite in the process of isothermal transformation, which improves the content of carbon in the residual austenite, and stabilizes the residual austenite; and adding a trace amount of element Nb can refine the sizes of grains in the original austenite in the heat treatment process, and a finer bainite ferrite lath sizes may be obtained in the process of the isothermal transformation so as to improve the plasticity and impact toughness of the steel plate.

Specifically, C: Carbon is the most basic element in steels, and also one of the most important elements in the present invention. Carbon as an interstitial atom in steels plays a very important role for improving the strength of the steel. In addition to improving the strength of the steel, a higher carbon content can increase the carbon content of the residual austenite in the isothermal treatment process, improving the heat stability of the residual austenite. Generally, the higher the strength of a steel, the lower the elongation. In the present invention, in order to ensure obtaining a high-strength steel plate having a tensile strength of not less than 800 MPa during the heat treatment, the content of carbon in the steel should at least reach 0.15%. A lower content of carbon cannot ensure the full diffusion of carbon into the residual austenite from the bainite ferrite in the process of isothermal transformation of the steel plate, which thereby affects the stability of the residual austenite. In another aspect, the content of carbon in the steel shall not be too high; if the carbon content is greater than 0.25%, although the strength of the steel can be ensured; massive austenite is easy to appear in the structure, which is very adverse to the impact toughness of the steel. Therefore, not only is the contribution of the carbon content to the strength considered, but also the effect of the carbon content to the stability of the residual austenite and the steel plate performance is also considered. A more appropriate carbon content in the present invention should be controlled at 0.15-0.25%, which can ensure that the steel plate has a good match of strength, plasticity and toughness.

Si: Silicon is the most basic element in steels, and also one of the most important elements in the present invention. Si can inhibit the precipitation of cementite within a certain range of temperature and time, and the inhibition of Si on the precipitation of cementite allows carbon atoms to diffuse to the residual austenite from the bainite ferrite, thereby stabilizing the residual austenite. In addition, more Al is further added in the present invention, and the inhibition of Si and Al together on the precipitation of cementite has a more remarkable effect. The content of Si is generally not lower than 1.0%, otherwise, the inhibition on the precipitation of cementite may not be effected; and the content of Si should also not exceed 2.0% in general, otherwise, hot cracking easily occurs when welding the steel plate, which is adverse to the impact toughness of the steel plate, and thus the content of Si in the steel is generally controlled at 1.0-2.0%, preferably in a range of 1.3-1.7%.

Mn: Manganese is the most basic element in steels, and also one of the most important elements in the present invention. As is known, Mn is an important element of enlarging the austenite phase region, can reduce the critical quenching rate of the steel, stabilizes the austenite, refines grains, and postpones the transformation of the austenite to pearlite. In the present invention, in order to ensure the strength of the steel plate, the content of Mn should be generally controlled at not less than 1.2%, wherein if the content of Mn is excessively low, supercooled austenite is not stable, and is easily transformed into a pearlite type structure such as sorbite when during the isothermal heat treatment; in addition, the content of Mn should not exceed 2.0% in general, segregation of Mn easily occurs when steel-making, and heat cracking easily occurs during continuous casting of the slab. Therefore, the content of Mn in the steel is generally controlled at 1.2-2.0%, preferably in a range of 1.4-1.8%.

P: Phosphorus is an impurity element in steels. P is very easily segregated in the grain boundary; when the content of P in the steel is higher (≥0.1%), $Fe_2P$ is formed and precipitated around the grains, which reduces the plasticity and toughness of the steel; therefore, it is better that the content thereof is lower, the content thereof being better controlled within 0.015% in general without increasing the costs of steel-making.

S: Sulphur is an impurity element in steels. S in the steel generally combines with Mn to form a MnS inclusion, especially when the contents of S and Mn are both higher, more MnS will be formed in the steel; moreover, MnS itself has a certain plasticity, and in the subsequent rolling process, transformation easily occurs to MnS in the rolling direction, which reduces the transverse tensile property of the steel plate. Therefore, it is better that the content of S is lower, the content thereof being generally controlled within 0.005% during practical production.

Al: Aluminium is one of the most important alloy elements in the present invention. The basic function of Al is deoxidation in the process of steel-making. Besides, Al can further combine with N in the steel to form AlN and refine the grains, i.e., the function of "deoxidation and nitrogen fixation" of Al. In addition to the above-mentioned function, adding more Al in the present invention mainly has objects as follows: one is improving the diffusion rate of carbon atoms to the residual austenite from the bainite ferrite, so as to improve the heat stability of the residual austenite and obtain more residual austenite as much as possible at room temperature; and the other one is that the function of Al is partially similar to that of Si, Al can also play a role of inhibiting the precipitation of cementite, and the addition of Si and Al together can improve such an inhibition effect. If the content of Al in the steel is lower than 0.5%, the effect of facilitating the diffusion of carbon atoms is weaker; and if the content of Al in the steel is higher than 1.0%, the steel liquid will become more viscous, whereby the nozzle clogging very easily occurs in the process of continuous casting, and defects such as longitudinal surface cracks easily occur to the continuous casting slab. Therefore, the content of Al in the steel needs to be controlled within an appropriate range, generally 0.5-1.0%; in addition, for the purpose that the optimal mechanical properties can be obtained within a wider process window range, the addition amounts of Al and Si should further satisfy the following relational formula: $1.5\% \leq Si+Al \leq 2.5\%$.

N: Nitrogen is also an inevitable element in the steel, and in general cases, the residual content of N in the steel is between 0.002-0.004%, wherein the solid-dissolved or free N element can be fixed by combining with acid soluble Al. In order not to improve the steel-making costs, the content of N can be controlled within 0.006%, preferably in a range of less than 0.004%.

Nb: Niobium is one of the important elements in the present invention. Nb is present in mainly two forms in the steel, i.e., Nb is solid-dissolved in the steel or forms with elements such as C, N to form a carbonitride. In a stage of heat treatment of austenitization, solid-dissolved Nb and Nb carbonitrides respectively refine the grains of the original austenite by a solute drag and pinning effect to improve the plasticity and toughness of the steel and increase the strength. The content of Nb in the present invention is controlled at 0.02-0.06%, preferably in a range of 0.03-0.05%.

O: Oxygen is an inevitable element in the process of steel-making, and in the present invention, the content of O in the steel after deoxidation by Al can generally reach not higher than 0.003% in all cases, which will not cause an obvious adverse effect on the performance of the steel plate. Therefore, the content of O in the steel can be controlled within 0.003%.

The method for manufacturing the high-strength and high-toughness steel plate with an 800 MPa grade tensile strength of the present invention comprises the following steps:

1) smelting, secondary refining, and casting:

according to the following composition, smelting is performed using a converter furnace or an electric furnace, secondary refining is performed using a vacuum furnace, and casting is performed to form a cast slab or cast ingot; the contents of the chemical components in weight percentage being: C: 0.15-0.25%, Si: 1.0-2.0%, Mn: 1.2-2.0%, P: ≤0.015%, S: ≤0.005%, Al: 0.5-1.0%, N: ≤0.006%, Nb: 0.02-0.06%, O: ≤0.03%, and the balance of Fe and inevitable impurities, with 1.5%≤Si+Al≤2.5% being satisfied;

2) the cast slab or cast ingot obtained in step 1) is subjected to heating, hot rolling, coiling, re-uncoiling plate and cutting into plates to obtain a substrate; and 3) heat treatment the substrate obtained in step 2) is heated to $Ac_3$+(30-50)° C., for a full austenite homogenization, wherein $Ac_3$=955−350C−25Mn+51Si+106Nb+68Al, with the various element symbols all referring to the contents in weight percentage; after the core part of the substrate is heated to a temperature of $Ac_3$+(30-50)° C., the substrate is continued to be maintained at the temperature for 10-30 min, is further rapidly cooled to a certain temperature between 350-500° C. at a cooling rate of >50° C./s, is subjected to isothermal transformation for 200-500 s, and is quenched at a cooling rate of greater than 30° C./s to room temperature to obtain a high-strength and high-toughness steel plate with an 800 MPa grade tensile strength.

Preferably, in the chemical composition of said high-strength and high-toughness steel plate with an 800 MPa grade tensile strength, the content of Si is in a range of 1.3-1.7%; the content of Mn is in a range of 1.4-1.8%; the content of N is ≤0.004%; and the content of Nb is in a range of 0.03-0.05%, in weight percentage.

Further, the microstructure of the obtained high-strength and high-toughness steel plate with an 800 MPa grade tensile strength mainly includes bainite ferrite and residual austenite, and has a yield strength of ≥390 MPa, a tensile strength of ≥800 MPa, an elongation of >20%, and an impact energy at −20° C. of >100 J.

In the manufacturing method of the present invention:

In the heat treatment process of the present invention, there is no special requirements on the original structure in the heat treatment of a substrate, a hot continuous rolling process which is most commonly used in factories at present is used to obtain a steel coil of a type of ferrite plus pearlite, and then the steel coil undergoes plate cutting after having been uncoiled such that a substrate of high-strength steel after the heat treatment can be obtained.

When heating, the heating temperature for the substrate should be $Ac_3$+(30-50)° C. so as to obtain finer original austenite grains, and after the core part of the substrate reaches the temperature, heat preservation is continued for 10-30 min, which is appropriately adjusted according to the difference of thickness of the heat-treated substrate, wherein the greater the thickness, correspondingly the longer the time of the heat preservation, and a suitable range of substrate thickness is 3-12 mm.

The temperature range of $Ac_3$ of the steel species of the chemical composition system in the present invention is 905-1048° C., the $Ac_3$ temperature being higher, and with regard to a C—Mn steel, the heat treatment of austenitization within the temperature range will result in that the austenite grains become coarse. Therefore, in order to obtain finer original austenite grains, a trace amount of element Nb needs to be added, wherein Nb forms Nb (C, N) with elements C, N etc. in the steel, which may have pinning on the growth of austenite grains; and it can be seen after calculation that adding 0.02-0.06% of the element Nb can still provide a good pinning effect within a range of ≤1297° C., so as to ensure obtaining finer austenite grains during the austenitization. Adding the element Al into the steel can accelerate the kinetics process of the phase transformation reaction, and also inhibits the precipitation of cementite in the phase transformation process. In the present invention, Al and Si must cooperate with each other, and it is demonstrated by trials that these two elements have to satisfy 1.5%≤Si+Al≤2.5% such that it can be ensured that there is no or an extremely small amount of cementite present in the process of forming bainite ferrite by the isothermal phase transformation.

After experiencing the full austenite homogenization, the substrate is rapidly cooled to a certain temperature between 350-500° C., i.e., a first cooling stopping temperature. Then, the more rapid the cooling rate, the better, and the cooling rate needs to be >50° C./s in general; heat preservation is then performed at this temperature for 200-500 s, isothermal transformation is performed, and after the completion of the bainite transformation, a structure mainly having bainite ferrite+residual austenite is obtained. The temperature and time of the heat preservation determines the lath size of the bainite ferrite and the content of the residual austenite. In the isothermal transformation stage, carbon atoms are expelled from the bainite ferrite and diffused to the residual austenite; although the residual austenite at this time has carbon enrichment occurred by the carbon atom diffusion, and the heat stability is improved, not all the residual austenite can be retained to room temperature, and by a re-quenching process, an extremely small amount of unstable residual austenite is transformed into martensite, to finally obtain a structure mainly having bainite ferrite+stable residual austenite (or comprising a small amount of martensite) at room temperature. If the first cooling stopping temperature is not higher than the starting temperature point Ms of martensite phase transformation, a small amount of martensite is first formed, and thereafter due to the enrichment of carbon atoms in the remaining austenite, the point Ms of the residual austenite is decreased, and the carbon atoms actually enter into a bainite transformation zone to thereby form a structure of bainite ferrite+a small amount of martensite+residual austenite; and if the first cooling stopping temperature is in a certain range of not less than Ms, a structure of bainite ferrite+residual austenite is directly formed.

Generally, the temperature range of the isothermal transformation is controlled between Ms±50-500° C., and according to a calculation formula for the starting temperature Ms of martensite phase transformation:

Ms=539−423C−30.4Mn−17.7Ni−12.1Cr−11.0Si−7.0Mo, the various element symbols in the formula respectively representing their corresponding contents in weight percentage.

It can be seen from calculation that the temperature of point Ms of the steel species of the chemical composition system of the present invention is in a range of 350-438° C.; moreover, it can be seen according to previous researches that when performing isothermal treatment near Ms±50° C., a structure mainly having bainite ferrite will still be obtained. According to a calculation formula for the starting point of bainite transformation: Bs=656−58C−35Mn−75Si−15Ni−34Cr−41Mo, it can be seen that the temperature of point Bs is in a range of 422-530° C. Therefore, by the isothermal treatment at all temperatures in a range of 350-530° C., a structure of bainite ferrite and residual austenite can be obtained, and considering that when performing the isothermal treatment at above 500° C., a pearlite type structure such as sorbite may easily appear in the steel or the formed bainite ferrite structure is coarser, and in fact, it is difficult for the tensile strength of the steel plate to reach not less than 800 MPa; and the temperature of the isothermal transformation also shall not be too low, otherwise, excess martensite structure will appear in the steel, which will reduce the plasticity and impact toughness of the steel. Therefore, according to the chemical composition system of the present invention, the temperature range of the isothermal transformation is set between 350-500° C.

When performing heat preservation within a temperature range of 350-500° C., the time of the heat preservation is likewise very important. Since the time of the bainite ferrite transformation is in a magnitude order of hundreds of seconds, with regard to the steel species of the chemical composition system of the present invention, if the heat preservation time is less than 200 s, the process of the bainite ferrite phase transformation is not completely performed; and if the heat preservation time exceeds 500 s, the bainite ferrite lath is easily coarsen, which reduces the strength, plasticity and toughness of the steel. Therefore, the time of the isothermal transformation should also be controlled within a rational range, and in the manufacturing method of the present invention, the time of the isothermal transformation is controlled at 200-500 s.

By a rational alloy composition and process design, the present invention can be used for manufacturing an advanced high-strength steel plate with an 800 MPa grade tensile strength; moreover, the steel plate has a good elongation (>20%) and low-temperature impact toughness (an impact energy −20° C. of >100 J), and shows an excellent match of strength, plasticity and toughness.

The present invention has the following beneficial effects:

1) As compared to a traditional heat treatment type high-strength steel, a high-strength steel with a tensile strength of not less than 800 MPa can be obtained without adding many noble metals such as Cu, Ni, V, Mo in the technical solution of the present invention, which reduces the alloy cost.

2) Generally, under the conditions of the same strength grade, a high-strength steel having a phase transformation induced plasticity (TRIP) effect shows higher plasticity. As compared to an on-line continuously hot-rolled high-strength steel, a high-strength steel plate manufactured by the production process of the present invention has a higher content of residual austenite in the structure, and the TRIP effect occurs in the process of tensile or transformation, which thus improves the plasticity of the steel plate; therefore, the steel plate of the present invention has higher plasticity and an elongation thereof of >20%; however, the elongation of a continuously hot-rolled high-strength steel of the same grade is generally ≤20%.

3) The steel plate obtained in the present invention has an excellent match of high strength, high plasticity and high toughness, and has a very low yield ratio. The steel plate obtained in the present invention has a higher content (≥13.0%) of residual austenite contained in the structure, the residual austenite being a soft phase, which has a lower yield strength, wherein in the initial stage of the transformation, the residual austenite yields first to make the steel plate have a low yield strength; however, the bainite ferrite has a high tensile strength, and the ratio of the two allows the treated steel plate to have an ultralow yield ratio; in addition, in the following transformation process, a phase transformation induced plasticity effect (TRIP) phenomenon occurs to the residual austenite, such that not only can the plasticity of the steel plate be improved, but also the tensile strength is also improved.

4) The high-strength steel plate of the present invention has a lower yield strength, and with regard to many users, the bending and shaping are more easy; and secondly, the high strength, high plasticity and high toughness that the steel plate has can be used for manufacturing stress structural components with more complex shapes, such as automotive frame.

5) The novel high-strength steel plate produced by the method of the present invention has features of a good plate shape, an uniform structure performance; in addition, the fluctuation of production performance on the heat treatment line is small, this is what the continuously hot-rolled high-strength steel does not have.

DESCRIPTION OF THE DRAWINGS

FIG. 1 is a flow diagram of a heat treatment process of examples of the present invention.

PARTICULAR EMBODIMENTS

The present invention is further illustrated below in conjunction with the examples and the drawing.

The method for manufacturing the high-strength and high-toughness steel plate with an 800 MPa grade tensile strength of the present invention specifically comprises the following steps:

1) smelting, secondary refining, and casting:

according to the composition of each steel in table 1, smelting is performed using a rotary furnace or electric furnace, secondary refining is performed using a vacuum furnace, and casting is performed to form a cast slab or cast ingot;

2) the cast slab or cast ingot obtained in step 1) is subjected to heating, hot rolling, coiling, re-uncoiling and plate cutting to obtain a substrate; and 3) heat treatment the substrate obtained in step 3) is heated to $Ac_3$+(30-50)° C., for a full austenite homogenization; after the core part of the steel plate is heated to the temperature, the steel plate is continued to be maintained at the temperature for 10-30 min, is further rapidly cooled to a certain temperature between 350-500° C., i.e., a first cooling stopping temperature, at a cooling rate of >50° C./s, is subjected to isothermal transformation for 200-500 s, and is quenched at a cooling rate of greater than 30° C./s to room temperature to obtain a high-strength and high-toughness steel plate with an 800 MPa grade tensile strength. Reference is made to FIG. 1.

The specific composition and process parameters of the examples are as shown in tables 1 and 2. The corresponding properties of the steel plate in each example are as shown in table 3.

By a rational alloy composition and process design in the present invention, the steel plate having a high strength, a high plasticity and a high toughness produced using the novel heat treatment process, wherein the steel plate has a tensile strength which can reach not less than 800 MPa, and further has a good elongation (>20%) and a low-temperature impact toughness (an impact energy −20° C. of >100 J), and shows an excellent match of strength, plasticity and toughness.

TABLE 1

Unit: weight percentage

| Example | C | Si | Mn | P | S | Al | N | Nb | O | Ms ° C. | $Ac_3$ ° C. |
|---|---|---|---|---|---|---|---|---|---|---|---|
| 1 | 0.19 | 1.8 | 1.25 | 0.007 | 0.003 | 0.53 | 0.0055 | 0.050 | 0.0028 | 401 | 990 |
| 2 | 0.22 | 1.7 | 1.55 | 0.007 | 0.004 | 0.65 | 0.0052 | 0.040 | 0.0027 | 380 | 974 |
| 3 | 0.25 | 1.2 | 1.97 | 0.008 | 0.005 | 0.94 | 0.0046 | 0.020 | 0.0022 | 360 | 945 |
| 4 | 0.23 | 1.4 | 1.90 | 0.010 | 0.004 | 0.87 | 0.0038 | 0.035 | 0.0029 | 369 | 961 |
| 5 | 0.15 | 1.9 | 1.45 | 0.009 | 0.005 | 0.55 | 0.0039 | 0.060 | 0.0026 | 409 | 1012 |
| 6 | 0.20 | 1.5 | 1.63 | 0.008 | 0.004 | 0.82 | 0.0041 | 0.045 | 0.0027 | 388 | 981 |
| 7 | 0.17 | 1.0 | 1.38 | 0.009 | 0.003 | 0.75 | 0.0043 | 0.030 | 0.0023 | 414 | 966 |

TABLE 2

| | Heat treatment process | | | | |
|---|---|---|---|---|---|
| Example | Thickness of steel plate, mm | Heating temperature, ° C. | Homogenization time, min | Cooling stopping temperature, ° C. | Isothermal transformation time, s |
| 1 | 10 | 1020 | 25 | 400 | 250 |
| 2 | 3 | 1005 | 13 | 475 | 200 |
| 3 | 6 | 945 | 18 | 350 | 300 |
| 4 | 12 | 995 | 30 | 450 | 500 |
| 5 | 5 | 1050 | 15 | 375 | 450 |
| 6 | 9 | 1115 | 10 | 500 | 400 |
| 7 | 7 | 1000 | 20 | 425 | 375 |

TABLE 3

| | Mechanical property | | | | | Residual |
|---|---|---|---|---|---|---|
| Example | Tensile yield strength, MPa | Tensile strength, MPa | Yield ratio | Elongation, % | Impact energy, J | austenite Content, % |
| 1 | 420 | 880 | 0.48 | 23 | 150 | 18.0 |
| 2 | 400 | 870 | 0.46 | 29 | 155 | 14.5 |
| 3 | 420 | 900 | 0.47 | 22 | 120 | 15.0 |
| 4 | 415 | 875 | 0.47 | 28 | 148 | 14.0 |
| 5 | 412 | 895 | 0.46 | 21 | 144 | 17.5 |
| 6 | 390 | 850 | 0.46 | 28 | 145 | 13.0 |
| 7 | 425 | 875 | 0.49 | 32 | 158 | 17.5 |

The invention claimed is:

1. A high-strength and high-toughness hot-rolled steel plate with a tensile strength of 800-900 MPa, the chemical composition of the steel plate in weight percentage being: C: 0.15-0.25%, Si: 1.0-2.0%, Mn: 1.2-2.0%, P≤0.015%, S≤0.005%, Al: 0.53-1.0%, N≤0.006%, Nb: 0.02-0.06%, O≤0.003%, and the balance being Fe and other inevitable impurities, and 1.53%≤Si+Al≤2.5%, and wherein the steel plate has a microstructure consisting of bainitic ferrite and 13.0% or more of residual austenite, wherein the steel plate has a yield strength of ≥390 MPa, an elongation of >20%, and an impact energy at −20° C. of >100 J, and wherein the steel plate has a thickness of 3-12 mm.

2. The high-strength and high-toughness steel plate according to claim 1, wherein the content of Si, in weight percentage, is in a range of 1.3-1.7%.

3. The high-strength and high-toughness steel plate according to claim 1, wherein the content of Mn, in weight percentage, is in a range of 1.4-1.8%.

4. The high-strength and high-toughness steel plate according to claim 1, wherein the content of N, in weight percentage, is ≤0.004%.

5. The high-strength and high-toughness steel plate according to claim 1, wherein the content of Nb, in weight percentage, is in a range of 0.03-0.05%.

6. A method for manufacturing the high-strength and high-toughness steel plate of claim 1, characterized by comprising the following steps:

1) smelting, secondary refining, and casting smelting by using a converter furnace or an electric furnace, secondary refining by using a vacuum furnace, and casting to form a cast slab or cast ingot, with the following chemical components and amounts thereof in weight percentage: C: 0.15-0.25%, Si: 1.0-2.0%, Mn: 1.2-2.0%, P: ≤0.015%, S: ≤0.005%, Al: 0.53-1.0%, N: ≤0.006%, Nb: 0.02-0.06%, O: ≤0.03%, and the balance of Fe and other inevitable impurities, and 1.53%≤Si+Al≤2.5%;

2) heating, hot rolling, coiling, and re-uncoiling the cast slab or cast ingot obtained in step 1) and cutting to plates to obtain a substrate; and 3) heat treatment heating the substrate obtained in step 2) to Ac3+(30-50)° C., Ac3=955-350C-25Mn+5 I Si+106Nb+68Al, with the various element symbols all referring to the contents in weight percentage in the formula; holding for 10-30 min after the temperature of the core of the substrate arrives at a temperature of Ac3+(30-50)° C., then rapidly cooling to 350-500° C. at a cooling rate >50° C./s, and then subjecting to isothermal transformation for 200-500s, quenching at a cooling rate of greater than 30° C./s to room temperature to obtain a high-strength and high-toughness steel plate with a tensile strength of 800-900 MPa.

7. The method for manufacturing the high-strength and high-toughness steel plate according to claim 6, characterized in that the microstructure of the steel plate obtained by the manufacturing method consists of bainitic ferrite and 13.0% or more residual austenite.

* * * * *